US005918303A

United States Patent [19]

Yamaura et al.

[11] Patent Number: 5,918,303

[45] Date of Patent: Jun. 29, 1999

[54] PERFORMANCE SETTING DATA SELECTING APPARATUS

[75] Inventors: Atsushi Yamaura; Takeo Shibukawa, both of Hamamatsu, Japan

[73] Assignee: Yamaha Corporation, Japan

[21] Appl. No.: 08/978,464

[22] Filed: Nov. 25, 1997

[30] Foreign Application Priority Data

Nov. 25, 1996 [JP] Japan ..... 8-314037

[51] Int. Cl.[6] ..... G10H 1/06; G10H 1/26; G10H 1/36

[52] U.S. Cl. ..... 84/609; 84/610; 84/612; 84/622; 84/477 R; 434/307 A

[58] Field of Search ..... 84/609–614, 622–625, 84/634–638, 477 R, 478, DIG. 12, 601, 602; 434/307 A

[56] References Cited

U.S. PATENT DOCUMENTS 5,574,239 11/1996 Kang et al. ..... 84/610
5,648,628 7/1997 Ng et al. ..... 84/610
5,663,515 9/1997 Kato ..... 84/609
5,679,911 10/1997 Moriyama et al. ..... 84/601

FOREIGN PATENT DOCUMENTS

A562435 3/1993 Japan .
A7306680 11/1995 Japan .

*Primary Examiner*—Stanley J. Witkowski
*Attorney, Agent, or Firm*—Rossi & Associates

[57] ABSTRACT

A performance setting data selecting apparatus including: a data storing unit for storing a plurality set of performance setting data; a table for storing a correspondence between each tune name of the plurality of tunes and each set of the performance setting data stored in the data storing unit suitable for playing a tune having the associated tune name; a designating unit for designating a tune name; and a unit for reading the performance setting data corresponding to the tune name designated by the designating unit from the data storing unit by referring to the table and setting the read performance setting data.

23 Claims, 13 Drawing Sheets

| TUNE NUMBER (ABC ORDER) | TUNE NAME | ARTIST NUMBER | COM-POSER NUMBER | GENRE NUMBER | STYLE NUMBER | TONE COLOR NUMBER | TEMPO VALUE | HARMONY NUMBER |
|---|---|---|---|---|---|---|---|---|
| 1 | AAAA | 35 | 5 | 22 | 10 | 1 | 150 | 2 |
| 2 | AAAB | 1 | 25 | 3 | 26 | 58 | 80 | 0 |
| 3 | BBBB | 18 | 32 | 11 | 10 | 36 | 110 | 4 |
| ⋮ | ⋮ | ⋮ | ⋮ | ⋮ | ⋮ | ⋮ | ⋮ | ⋮ |
| 400 | ZZZZ | 67 | 3 | 19 | 62 | 1 | 75 | 5 |

35 36 37 38

FIG.6

| TUNE NUMBER (ABC ORDER) | TUNE NAME | ARTIST NUMBER | COM-POSER NUMBER | GENRE NUMBER | STYLE NUMBER | TONE COLOR NUMBER | TEMPO VALUE | HARMONY NUMBER |
|---|---|---|---|---|---|---|---|---|
| 1 | AAAA | 35 | 5 | 22 | 10 | 1 | 150 | 2 |
| 2 | AAAB | 1 | 25 | 3 | 26 | 58 | 80 | 0 |
| 3 | BBBB | 18 | 32 | 11 | 10 | 36 | 110 | 4 |
| ⋮ | ⋮ | ⋮ | ⋮ | ⋮ | ⋮ | ⋮ | ⋮ | ⋮ |
| 400 | ZZZZ | 67 | 3 | 19 | 62 | 1 | 75 | 5 |

35 36 37 38

FIG.7A

| ARTIST NUMBER | ARTIST NAME |
|---|---|
| 1 | Aaaa |
| 2 | Aabb |
| 3 | Bbbb |
| --- | --- |
| 80 | Zzzz |

FIG.7B

| COMPOSER NUMBER | COMPOSER NAME |
|---|---|
| 1 | aaaa |
| 2 | aabb |
| 3 | bbaa |
| --- | --- |
| 62 | zzzz |

FIG.7C

| GENRE NUMBER | GENRE NAME |
|---|---|
| 1 | Rock |
| 2 | Pops |
| 3 | Dance |
| --- | --- |
| 40 | Enka |

FIG.8A

| STYLE NUMBER | STYLE DATA |
|---|---|
| 1 | ... |
| 2 | ... |
| 3 | ... |
| ⋮ | ⋮ |
| 100 | ... |

| STYLE NAME |
|---|
| INITIAL TEMPO |
| TIME |
| NUMBER OF BARS |
| RHYTHM PATTERN |
| BASE PATTERN |
| CODE PATTERN |

FIG.8B

| TONE COLOR NUMBER | TONE COLOR DATA |
|---|---|
| 1 | ... |
| 2 | ... |
| 3 | ... |
| ⋮ | ⋮ |
| 100 | ... |

| TONE COLOR NAME |
|---|
| TONE COLOR PARAMETER |

FIG.8C

| HARMONY NUMBER | HARMONY DATA |
|---|---|
| 0 | NONE |
| 1 | ... |
| 2 | ... |
| 3 | ... |
| 4 | ... |

| HARMONY NAME |
|---|
| HARMONY PARAMETER |

| | SORT ORDER | TUNE NUMBER | TUNE NAME |
|---|---|---|---|
| P→ | 1 | 4 | ... |
| | 2 | 16 | ... |
| | 3 | 38 | ... |
| | ⋮ | ⋮ | ⋮ |
| | N | M | ... |

FIG.17

| SORT ORDER | STYLE NUMBER | TUNE NUMBER IN STYLE | TUNE NAME |
|---|---|---|---|
| 1 | 23 | 1 | ..... |
| 2 | 5 | 3 | ..... |
| 3 | 12 | 4 | ..... |
| ⋮ | ⋮ | ⋮ | ⋮ |
| N | 68 | 2 | ..... |

PERFORMANCE SETTING DATA SELECTING APPARATUS

This application is based on Japanese patent application No. 8-314037 filed on Nov. 25, 1996, the entire contents of which are incorporated herein by reference.

BACKGROUND OF THE INVENTION a) Field of the Invention

The present invention relates to performance setting data selecting techniques, and more particularly to performance setting data selecting techniques which facilitate to select performance setting data necessary for the execution of tone color data or the like.

b) Description of the Related Art

A performance setting data selecting apparatus is used with, for example, an automatic accompaniment apparatus. A user can select performance setting data necessary for automatic accompaniment by using the performance setting data selecting apparatus. The performance setting data is, for example, a combination of accompaniment style, tone color, tempo, harmony and the like.

One of the methods of selecting performance setting data is a method called one touch setting (OTS). How one touch setting is used will be described.

(1) An accompaniment style is first selected. For example, [Pop Ballad Style] is selected.

(2) A switch [OTS] is depressed to select performance setting data. Upon depression of this switch, a list of four tune images matching the selected accompaniment style is displayed on a display device.

[Pop Ballad Style]

1. Richard's Solo
2. Classic Guitar
3. Orchestral Ballad
4. Piano Ballad (3) One of the fours numbers displayed on the display device is selected with a switch.

(4) The performance setting data matching the tune of the selected number is automatically set. The automatically set performance setting data is the data other than the already set accompaniment style data, and may be melody tone color data, tempo data, harmony data and the like.

When a user plays a tune, it is possible to play only a melody line, while leaving accompaniment matching the melody line to an automatic accompaniment apparatus. In this case, the tune to be played by the user is already determined. Although it is difficult for an ordinary user to manually select each set of performance setting data matching the tune to be played, one touch setting can automatically set the performance setting data.

Even if a tune to be played is already determined, it is difficult to determine which accompaniment style and tune image are to be selected in order to set performance setting data matching the tune.

Further, with one touch setting, an accompaniment style is first selected and then a tune image is selected. Even if a suitable tune image can be known, it may happen that it is not certain which accompaniment style is to be selected in order to select the tune image.

Still further, since only an abstract title of a tune image to be selected is displayed after the accompaniment style is selected, it is difficult to image the final accompaniment.

Under the presence of such problems, even if an accompaniment style and tune image a user thinks proper are selected, the actual automatic accompaniment may not match the played tune.

Even if it is found that the actual automatic accompaniment does not match a tune, it is difficult for the user to find more suitable settings.

SUMMARY OF THE INVENTION

It is an object of the present invention to provide a performance setting data selecting apparatus, a performance setting data selecting method, and a medium storing programs for executing the method, capable of facilitating to select performance setting data matching a tune to be played.

According to one aspect of the present invention, there is provided a performance setting data selecting apparatus comprising: means for storing a correspondence between each of a plurality of tune names and performance setting data suitable for playing each tune; means for designating the tune name of each tune; and means for setting the performance setting data corresponding to the tune name of each tune designated by said designating means by reading the performance setting data from said storing means.

According to another aspect of the present invention, there is provided a performance setting data selecting apparatus comprising: data storing means for storing a plurality set of performance setting data; a table for storing a correspondence between each tune name of the plurality of tunes and each set of the performance setting data stored in said data storing means suitable for playing a tune having the associated tune name; means for designating a tune name; and means for reading the performance setting data corresponding to the tune name designated by said designating means from said data storing means by referring to said table and setting the read performance setting data.

By designating a tune name, a user can automatically set the performance setting data suitable for the performance of the tune having the designated tune name. Since a tune is easy to be imaged from the tune name, the performance setting data a user wishes to play can be set by designating the tune name.

According to another aspect of the present invention, there is provided a performance setting data selecting apparatus comprising: storing means for storing a plurality set of performance setting data and storing a correspondence between each tune name and each set of the performance setting data suitable for playing a tune having the associated tune name; means for designating the tune name of each tune; and means for setting the performance setting data corresponding to the tune name of each tune designated by said designating means by reading the performance setting data from said storing means.

The storing means stores the performance setting data, and also stores a correspondence between each tune name and each set of the performance setting data suitable for playing a tune having the associated tune name. It is therefore possible to easily add new performance setting data. By designating a tune name, a user can automatically set the performance setting data suitable for the performance of the tune having the designated tune name.

BRIEF DESCRIPTION OF THE DRAWINGS

FIG. 6 is a diagram showing the structure of a tune table.

FIGS. 7A to 7C are diagrams showing the structure of a keyword table, FIG. 7A shows the structure of an artist table, FIG. 7B shows the structure of a composer table, and FIG. 7C shows the structure of a genre table.

FIGS. 8A to 8C are diagrams showing the structure of performance setting data, FIG. 8A shows the structure of style data, FIG. 8B shows the structure of tone color data, and FIG. 8C shows the structure of harmony data.

FIG. 17 shows the structure of another sort table.

DETAILED DESCRIPTION OF THE PREFERRED EMBODIMENTS

FIGS. 1 to 4 are diagrams illustrating a method of selecting performance setting data by using a performance setting data selecting apparatus according to an embodiment of the invention. The performance setting data setting apparatus of this embodiment can automatically select performance setting data matching a tune selected by a user. This selecting method is called hereinafter song image setting (abbreviated as SIS).

Figure 1:
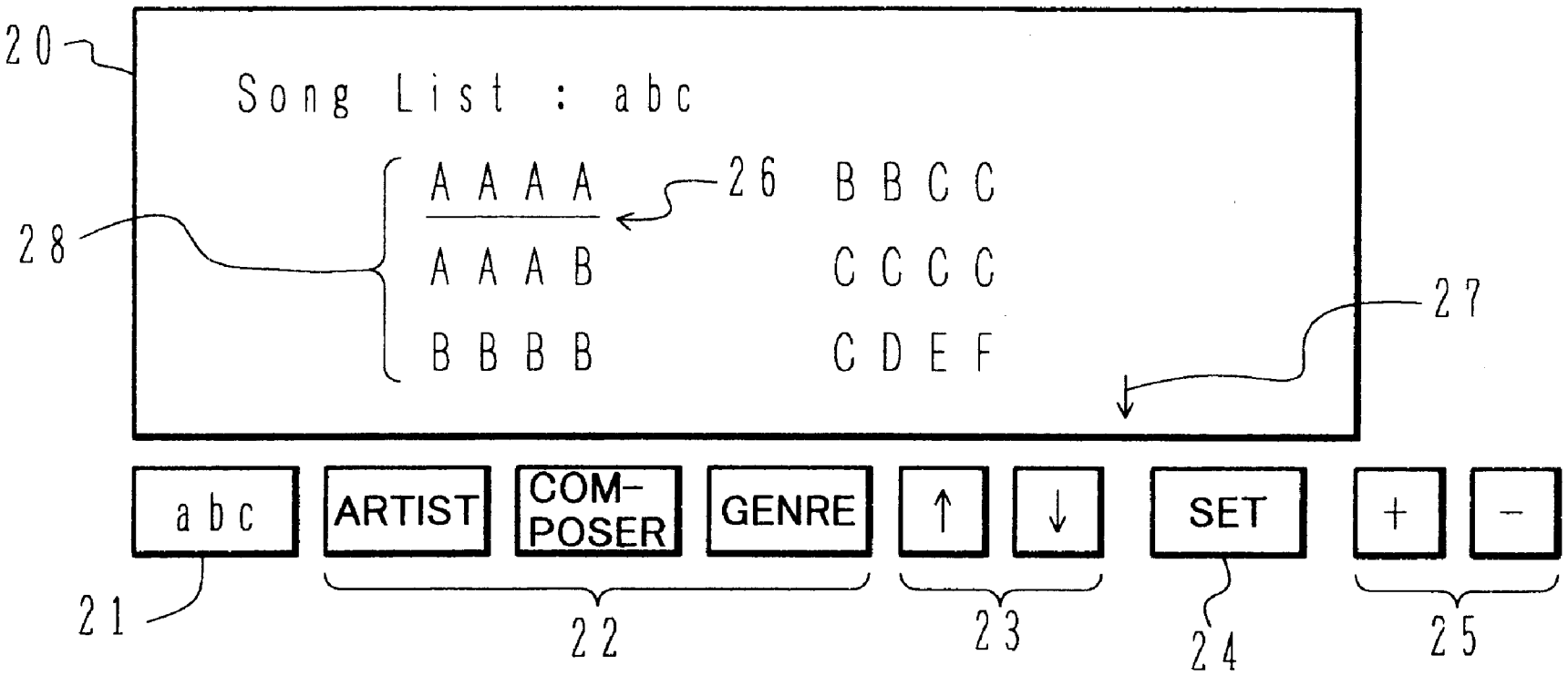
FIGS. 1 to 4 show a display screen which is used for selecting performance setting data by using a performance setting data selecting apparatus according to an embodiment of the invention.

FIG. 1 shows a display screen 20 of the performance setting data selecting apparatus and operation switches 21, 22, 23, 24 and 25.

An abc switch 21 is used for displaying a tune list on the display screen. For example, when this switch 21 is depressed, the names 28 of six tunes are displayed on the display screen 20 in an alphabetical order (in the order of a, b, c, . . . ) or in a Japanese syllabary order (in the order of a, i, u, e, o . . . (phonetic translation of Japanese phonemes)). For example, tune names 28 are displayed in the order of AAAA, AAAB, BBBB, BBCC, CCCC and CDEF.

An arrow 27 indicates that the next page continues. Only six tune names, for example, can be displayed on the display screen 20. If there are seven or more tune names, the arrow 27 is displayed to notify a user of the presence of other tune names still not displayed on this display screen. The tune names 28 are displayed on the display screen 20, for example, in two columns. AAAA, AAAB and BBBB are displayed on the left column, and BBCC, CCCC and CDEF are displayed on the right column.

A cursor 26 displayed on the display screen 20 can be moved by a user operating a cursor motion switch 23. As the cursor is moved down at the lowest position of the left column, the cursor moves to the highest position of the right column. Conversely, as the cursor is moved up at the highest position of the right column, the cursor moves to the lowest position of the left column. The succeeding tune names can be displayed on the display screen 20 by moving the cursor to the lowest position of the right column.

Next, a method of selecting a tune will be described. A user moves the cursor 26 to the position of a tune name 28 which the user wants to select, by operating the cursor motion switch 23. In the example shown in FIG. 1, the cursor 26 is at the position of the tune name AAAA. As the user depresses a set switch 24 in this state, performance setting data matching the tune name AAAA is automatically set. The details of the performance setting data will be later described.

In addition to the abc switch 21, cursor motion switch 23 and set switch 24, the apparatus is provided with a keyword switch 22 and a numerical value change switch 25. The keyword switch 22 includes an artist switch, a composer switch and a genre switch. By operating the keyword switch 22, a user can select one of the artist, composer and genre as a keyword.

In the following description, it is assumed that an artist is selected as the keyword. Similar operations are executed also when a composer or genre is selected as the keyword.

Figure 2:
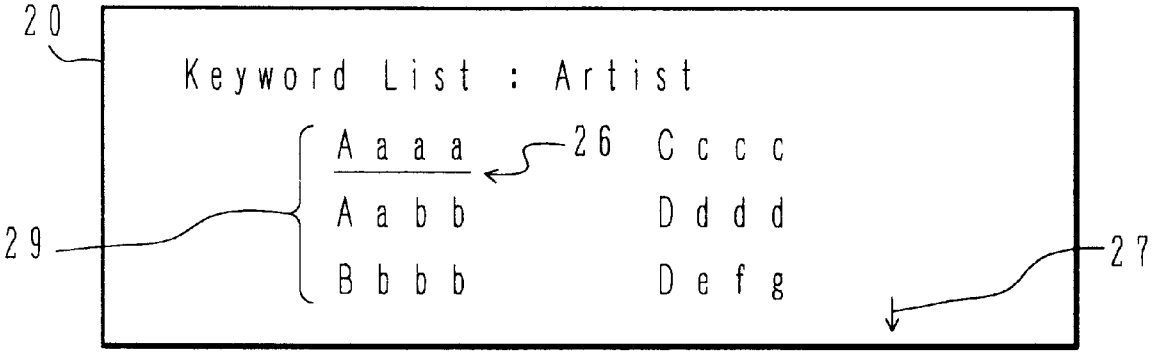

FIG. 2 shows a display screen in the case where an artist is selected as the keyword. In order to indicate that the artist was selected as the keyword, "Keyword List: Artist" is displayed on the upper area of the display screen 20. Although the operation switches same as those shown in FIG. 1 are actually displayed on the lower area of the display screen 20, they are omitted in FIGS. 2, 3 and 4.

By operating the keyword switch 22, an artist is selected as the keyword. A list of artists are displayed on the display screen 20 in the alphabetical order or in the Japanese syllabary order. For example, six artist names 29 are displayed on the display screen 20. The artist names 29 are displayed in the order of, for example, Aaaa, Aabb, Bbbb, Cccc, Dddd, and Defg. An artist is, for example, a player. An arrow 27 indicates that there are other artists still not displayed.

Next, a method of selecting an artist will be described. A user moves the cursor 26 to the position of an artist name 28 which the user wants to select, by operating the cursor motion switch 23. In the example shown in FIG. 2, the cursor 26 is at the position of the artist name Aaaa. As the user depresses the set switch 24 in this state, a list of names of tunes to be played by the artist is displayed on the display screen 20.

Figure 3:
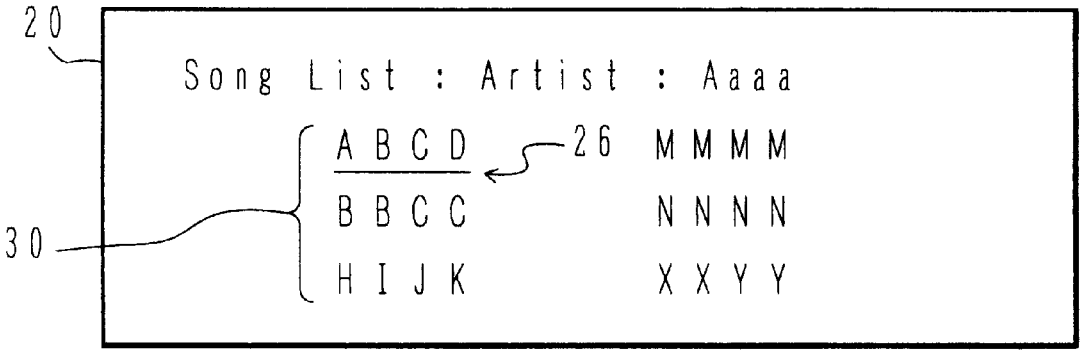

FIG. 3 shows a display screen 20 in the case where the artist name Aaaa is selected and the set switch 24 is depressed. In order to indicate that the artist name Aaaa was selected, "Artist: Aaaa" is displayed on the upper area of the display screen 20.

A list of names of tunes to be played by the selected artist Aaaa is displayed on the display screen 20 in the alphabetical order or in the Japanese syllabary order. For example, six tune names 30 are displayed on the display screen 20. The tune names 30 are displayed in the order of, for example, ABCD, BBCC, HIJK, MMMM, NNNN, and XXYY.

As shown in FIG. 1, when the abc switch 21 is operated, a list of all tunes is displayed. Since the number of tunes is very large, the keyword is used for reducing the number of tunes. For example, if an artist name Aaaa is selected as the keyword, a list of tunes belonging only to the artist Aaaa is displayed as shown in FIG. 3. By using the keyword, a user can find a desired tune name quickly and easily.

Next, with reference to FIG. 3, a method of selecting a tune will be described. A user moves the cursor 26 to the position of a tune name which the user wants to select, by operating the cursor motion switch 23. In the example shown in FIG. 3, the cursor 26 is at the position of the tune name ABCD. As the user depresses the set switch 24 in this state, performance setting data matching the tune name ABCD is displayed.

Figure 4:
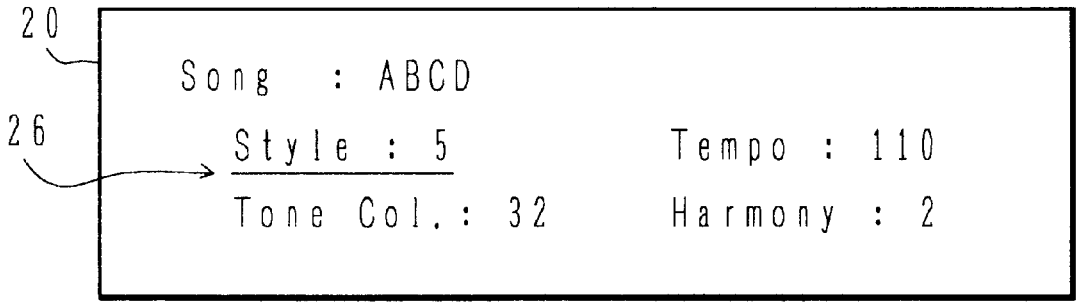

FIG. 4 shows a display screen 20 in the case where the tune name ABCD is selected as illustrated in FIG. 3. In order to indicate that the tune name ABCD was selected, "Song: ABCD" is displayed on the upper area of the display screen 20.

The contents of the performance setting data matching the selected tune name are displayed on the display screen. For example, the settings that an accompaniment style is the fifth style (Style: 5), a melody tone color is the thirty second melody tone color (Tone Col: 32), a tempo is 110 (Tempo: 110), and a harmony is the second harmony (Harmony: 2) are displayed on the display screen 20.

A user can determine whether or not the contents of the displayed performance setting data are satisfactory. If satisfactory, the set switch 24 is depressed to set the performance setting data.

If any portion of the contents of the performance setting data is to be corrected, a user moves the cursor 26 to the position of the performance setting data to be corrected, by operating the cursor motion switch 23. Thereafter, the numeral value change switch 25 shown in FIG. 1 is operated to correct the numerical value of the performance setting data. Thereafter, the set switch 24 is depressed to set the corrected performance setting data. In the above manner, even if the user dislikes a portion of the contents of the performance setting data, the contents can be corrected to those the user likes.

Figure 5:
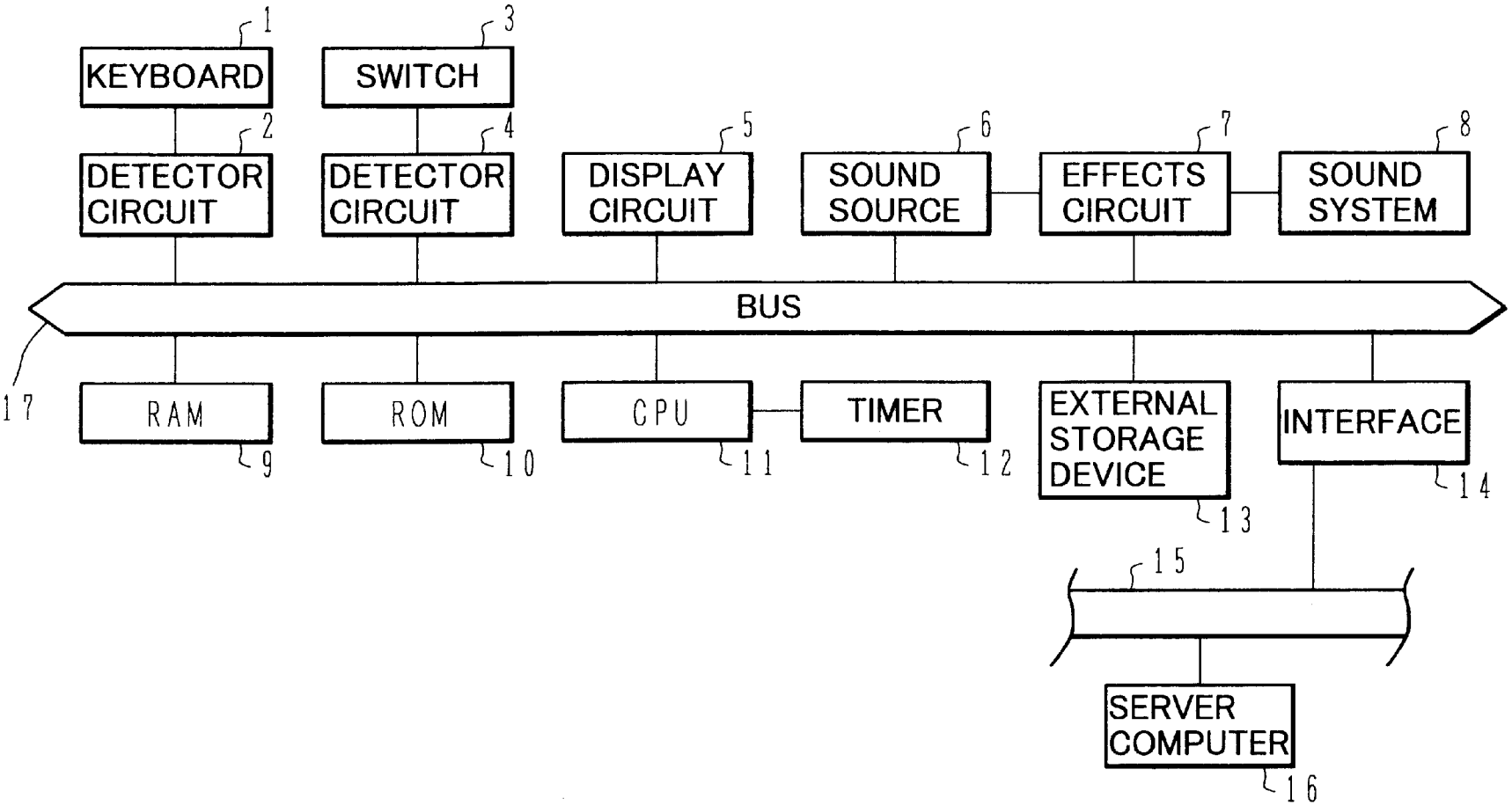
FIG. 5 is a block diagram showing the structure of the performance setting data selecting apparatus of the embodiment.

FIG. 5 is a block diagram showing the structure of an electronic musical instrument having the performance setting data selecting apparatus of this embodiment.

A key depression detector circuit 2 detects a key operation (key depression, key release and the like) of a keyboard 1, and generates a note-on signal, a note-off signal, a key code and the like. A switch detector circuit 4 detects a switch operation of a switch 3 and generates a switch signal. The switch 3 includes the abc switch 21, keyword switch 22, cursor motion switch 23, set switch and numerical value change switch 25 shown in FIG. 1.

A bus 17 is connected to the key depression detector circuit 2 and switch detector circuit 4 as well as a display circuit 5, a sound source (tone generator) circuit 6, an effects circuit 7, a RAM 9, a ROM 10, a CPU 11, an external storage device 13, and a communication interface 14.

RAM 9 has a working area for CPU 11, including flags, buffers and the like. ROM 10 stores various parameters and computer programs. CPU 11 executes calculations and controls in accordance with computer programs stored in ROM 10.

A timer 12 is connected to CPU 11. CPU 11 is supplied with time information from the timer 12. The communication interface 14 includes a musical instrument digital interface (MIDI) and other communication network interfaces to be described later.

The external storage device 13 includes an interface via which it is connected to the bus 17. The external storage device 13 may be a floppy disk drive (FDD), a hard disk drive (HDD), a magnetooptic drive (M)), a compact disk—read only memory (CD-ROM) drive or the like.

In the external storage device 13 or ROM 10, a tune table (FIG. 6), keyword tables (FIGS. 7A to 7C), performance setting data (FIGS. 8A to 8C) are stored which tables are used for setting the performance setting data. The details thereof will be later given.

The performance setting data includes performance data such as accompaniment style data (accompaniment pattern data). If the performance data is stored in the external storage device 13, the performance data is loaded from the external storage device 13 into RAM 9 to reproduce the performance data. Other performance setting data is also loaded from the external storage device 13 into RAM 9.

CPU 11 reads the performance data stored in RAM 9 or ROM 10 and supplies musical tone parameters and effects parameters to the sound source circuit 6 and effects circuit 7. CPU 11 generates the musical tone parameters and effects parameters in accordance with a note-on signal and the like generated by the key depression detector circuit 2 and a switch signal generated by the switch detector circuit, and supplies the generated parameters to the sound source circuit 6 and effects circuit 7.

The sound source circuit 6 generates musical tone signals in accordance with supplied musical tone parameters. The effects circuit 7 assigns effects such as delay and reverb to a musical tone signal generated by the sound source circuit 6, in accordance with the supplied effects parameters. The sound system 8 includes a D/A converter and a speaker, converts the supplied digital musical tone signal into an analog musical tone signal and reproduces it.

The sound source circuit 6 may use any method including a waveform memory method, a frequency modulation method, a physical model method, a higher harmonics synthesis method, a formant synthesis method, and an analog synthesizer method with a voltage controlled oscillator (VCO), a voltage controlled filter (VCF) and a voltage controlled amplifier (VCA).

The sound source circuit 6 may be configured not only by using dedicated hardware but also by using a digital signal processor (DSP) and microprograms or by using a CPU and software programs.

A single sound source circuit may be used time divisionally to form a plurality of sound generating channels, or a single sound source circuit may be used independently for each of a plurality of sound generating channels.

Without storing computer programs and various data in ROM 10, they may be stored in a hard disk loaded in HDD which is one type of the external storage device 13. By reading computer programs or the like from a hard disk and loading them in RAM 9, CPU 11 can execute operations similar to the case where computer programs or the like are stored in ROM 10. With this arrangement, addition, version-up and the like of computer programs or the like become easy.

Computer programs and various data can be stored in CD-ROM (external storage device 13). Computer programs or the like can be copied from CD-ROM to a hard disk. It becomes easy therefore to perform installation and version-up of computer programs or the like.

The communication interface 14 is connected to a communication network 15 such as a local area network (LAN), Internet and a telephone network, and via this communication network 15 to a server computer 16. If computer programs or the like are not stored in HDD, they can be down-loaded from the server computer 16. The electronic musical instrument as a server computer transmits a command for requesting a down-load of computer programs or the like to the server computer 16 via the communication interface 14 and communication network 15. Upon reception of this command, the server computer 16 distributes the requested computer programs or the like to the electronic musical instrument via the communication network 15. The electronic musical instrument receives the computer programs or the like via the communication interface 14 and stores them in HDD to thereby complete a down-load.

FIG. 6 shows the structure of a tune table stored in RAM or the like. The tune table stores a tune number 35, a tune name 36, a keyword 37, and a set of performance setting data 38, all being associated with each other. For example, the tune names 36 of 400 tunes are stored and each tune name 36 is assigned a specific tune number 35. It is preferable that the tune names 36 are disposed in the alphabetical order or in the Japanese syllabary order, and in the ascending order of the tune numbers 35.

The keyword 37 is constituted of an artist number, a composer number and a genre number. For example, the tune number No. 1 has a tune name AAAA, an artist number No. 35, a composer number No. 5, and a genre number No. 22. Each number is an identification number of the keyword. It is possible to search a tune name having a specific keyword by using the keyword 37.

The performance setting data 38 is constituted of a style number, a tone color number, a tempo value and a harmony number. For example, if the tune number No. 1 (tune name AAAA) is selected, the style number is set to 10, the tone color number is set to 1, the tempo value is set to 150 and the harmony number is set to 2.

FIGS. 7A to 7C show the structure of the keyword table stored in RAM or the like.

FIG. 7A shows the structure of the artist table. The artist table stores an artist number and an artist name, both being associated with each other. The artist number corresponds to the artist number of the keyword 37 shown in FIG. 6. For example, eighty artist names are stored in the artist table, each artist name being assigned a specific artist number. It is preferable that the artist names are disposed in the alphabetical order or in the Japanese syllabary order, and in the ascending order of the artist numbers.

FIG. 7B shows the structure of the composer table. The composer table stores a composer number and a composer name, both being associated with each other. The composer number corresponds to the composer number of the keyword 37 shown in FIG. 6. For example, sixty two composer names are stored in the composer table. It is preferable that the composer names are disposed in the alphabetical order or in the Japanese syllabary order, and in the ascending order of the composer numbers.

FIG. 7C shows the structure of the genre table. The genre table stores a genre number and a genre name, both being associated with each other. The genre number corresponds to the genre number of the keyword 37 shown in FIG. 6. For example, the genre name includes rock, pop, dance, and Japanese country song (Enka). It is preferable that the genre numbers are disposed in the order of higher user frequency or in a group containing similar genres.

FIGS. 8A to 8C show the structure of the performance setting data stored in RAM or the like.

FIG. 8A shows the structure of style data. Each set of style data is associated with a specific style number. The style number corresponds to the style number of the performance setting data 38 shown in FIG. 6. For example, the style data includes a style name, an initial tempo, a time, the number of bars, a rhythm pattern, a base pattern, and a code (chord) pattern.

The initial tempo is different from the tempo value shown in FIG. 6. The tempo value shown in FIG. 6 is a value set when a tune name is selected in the manner described earlier. The initial tempo shown in FIG. 8A is a tempo set not when a tune name is selected but when a style is singularly selected. Therefore, when a tune name is selected, the initial tempo is neglected and the tempo value shown in FIG. 6 is adopted.

The rhythm pattern, base pattern and code pattern each contain a plurality of pattern sections such as intro, main, fill-in and ending.

FIG. 8B shows the structure of tone color data. Each set of tone color data is associated with a specific tone color number. The tone color number corresponds to the tone color number of the performance setting data 38 shown in FIG. 6. For example, the tone color data includes a tone color name and a tone color parameter.

FIG. 8C shows the structure of harmony data. Each set of harmony data is associated with a specific harmony number. The harmony number corresponds to the harmony number of the performance setting data 38 shown in FIG. 6. The harmony number No. 0 does not have harmony data and harmony is not added. For example, it is better not to add harmony when a piano solo performance is played.

The harmony number No. 1 and following numbers have harmony data and add harmony. The harmony data includes a harmony name and a harmony parameter. Harmony parameters include information on how many musical tones having what degree are added to each melody tone to be played by a player, and information on the volume and reproducing timings of the musical tones.

Figures 9, 10:
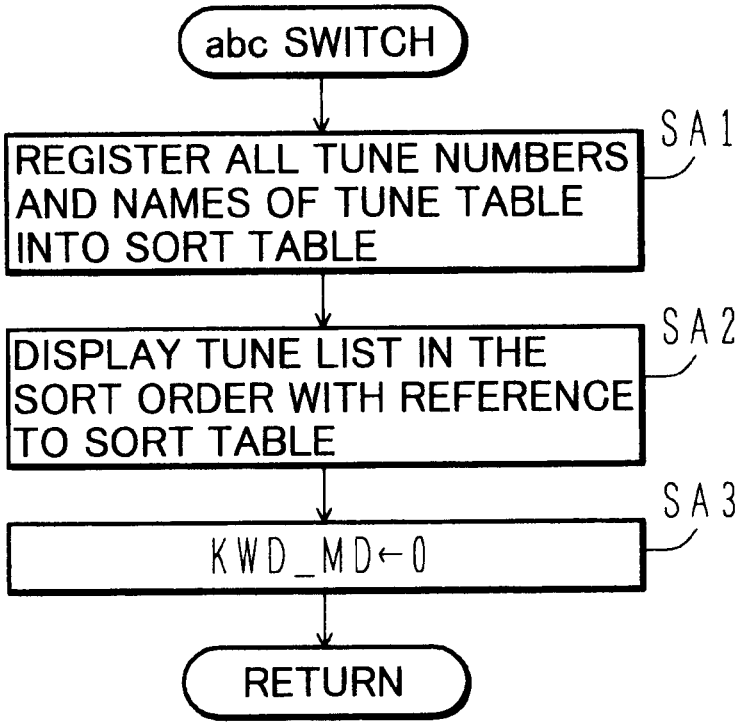
FIG. 9 is a flow chart illustrating an operation to be executed by CPU when an abc switch is operated.
FIG. 10 is a diagram showing the structure of a sort table.

FIG. 9 is a flow chart illustrating an operation to be executed by CPU when the abc switch is operated.

At Step SA1, all tune numbers and names in the tune table (FIG. 6) are registered in a sort table. FIG. 10 shows the structure of the sort table. The sort table stores a sort order, a tune number and a tune name, all being associated with each other. The sort table shown in FIG. 10 shows an example wherein after a keyword search is performed, tune numbers and names are registered, and the contents thereof are not necessarily coincident with the contents of the sort table (correspondence between sort order and tune number) at this Step. For example, if four hundred tunes are registered in the tune table shown in FIG. 6, all four hundred tune numbers and names are registered in the sort table.

If the tune names are disposed in the tune table shown in FIG. 6 in the alphabetical order or in the Japanese syllabary order, then the sort order and tune number having the same serial number are registered in the sort table when the abc switch is operated. However, if the tune names are not disposed in the tune table shown in FIG. 6 in the alphabetical order or in the Japanese syllabary order, the tune names are sorted in the alphabetical order or in the Japanese syllabary order and thereafter they are registered in the sort table. Therefore, even if the tune names are not disposed in the tune table shown in FIG. 6 in the alphabetical order or in the Japanese syllabary order, the tune names are disposed in the alphabetical order or in the Japanese syllabary order.

At Step SA2, a list of tune names is displayed on the display device by referring to the sort table, the tune names being disposed in the sort order. The tune names are disposed on the display device in the alphabetical order or in the Japanese syllabary order (FIG. 1).

At Step SA3, a keyword mode flag KWD_MD is set to 0 to terminate the process for the abc switch. When the keyword mode flag KWD_MD takes 0, the mode is a tune selection mode, and when it takes 1, the mode is a key word selection mode.

Figure 11:
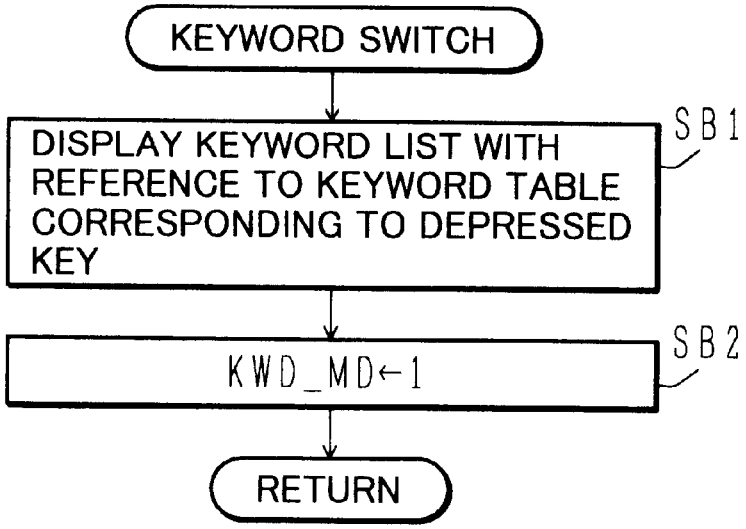
FIG. 11 is a flow chart illustrating an operation to be executed by CPU when a keyword switch is operated.

FIG. 11 is a flow chart illustrating an operation to be executed by CPU when the keyword switch is operated.

At Step SB1, with reference to a keyword table (FIGS. 7A to 7C) corresponding to the operated switch, a keyword list is displayed on the display device (FIG. 2). If the keyword is an artist or a composer, the keywords are displayed in the alphabetical order or in the Japanese syllabary order, whereas if the keyword is a genre, they are displayed in the order of higher use frequency or in a group containing similar genres.

At Step SB2, the keyword mode flag KWD_MD is set to 1 to terminate the process for the keyword switch. When the flag KWD_MD is set to 1, the keyword selection mode is set.

Figure 12:
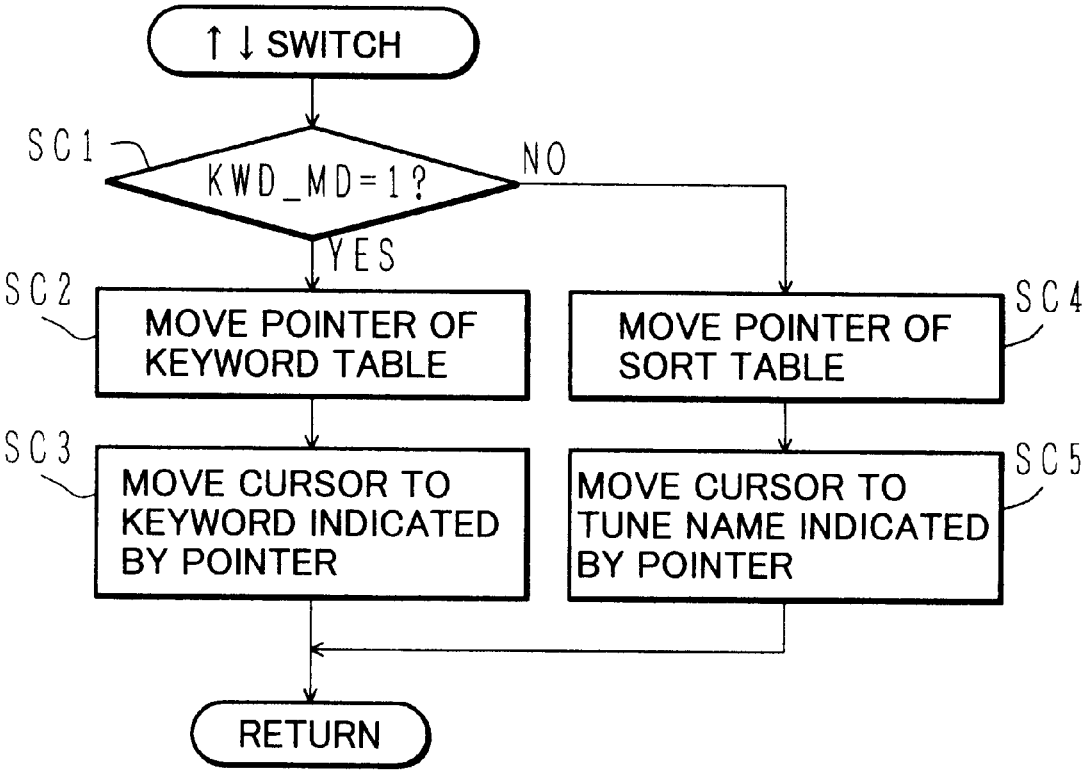
FIG. 12 is a flow chart illustrating an operation to be executed by CPU when a cursor switch is operated.

FIG. 12 is a flow chart illustrating the operation to be executed by CPU when the cursor motion switch is operated.

At Step SC1, it is checked whether the flag KWD_MD is 1. If the flag KWD_MD is 0, it means the tune selection mode so that the flow advances to Step SC4 along a NO arrow.

At Step SC4, an address pointer of the sort table (FIG. 10) is moved. At the initial stage, the address pointer P is at the head of the table as shown in FIG. 10. For example, if a cursor up-direction switch is operated, the address pointer is decremented, whereas if a cursor down-direction switch is operated, the address pointer is incremented.

At Step SC5, the cursor is moved on the display screen to the tune name indicated by the address pointer of the sort table and displayed at this position. If necessary, the display screen is scrolled or the arrow 27 indicating a presence of other tunes is displayed. Thereafter, the process for the cursor motion switch is terminated.

If it is judged at Step SC1 that the flag KWD_MD is 1, it means that the mode is the keyword selection mode, and the flow advances to Step SC2 along a YES arrow. Namely, if the cursor motion switch is moved after the keyword switch is operated, the flow advances to Step SC2.

At Step SC2, an address pointer of the keyword table (FIGS. 7A to 7C) is moved. For example, if the cursor up-direction switch is operated, the address pointer is decremented, whereas if the cursor down-direction switch is operated, the address pointer is incremented.

At Step SC3, the cursor is moved on the display screen to the keyword indicated by the address pointer of the keyword table. If necessary, the display screen is scrolled or the arrow 27 indicating a presence of other keywords is displayed. Thereafter, the process for the cursor motion switch is terminated.

Figure 13:
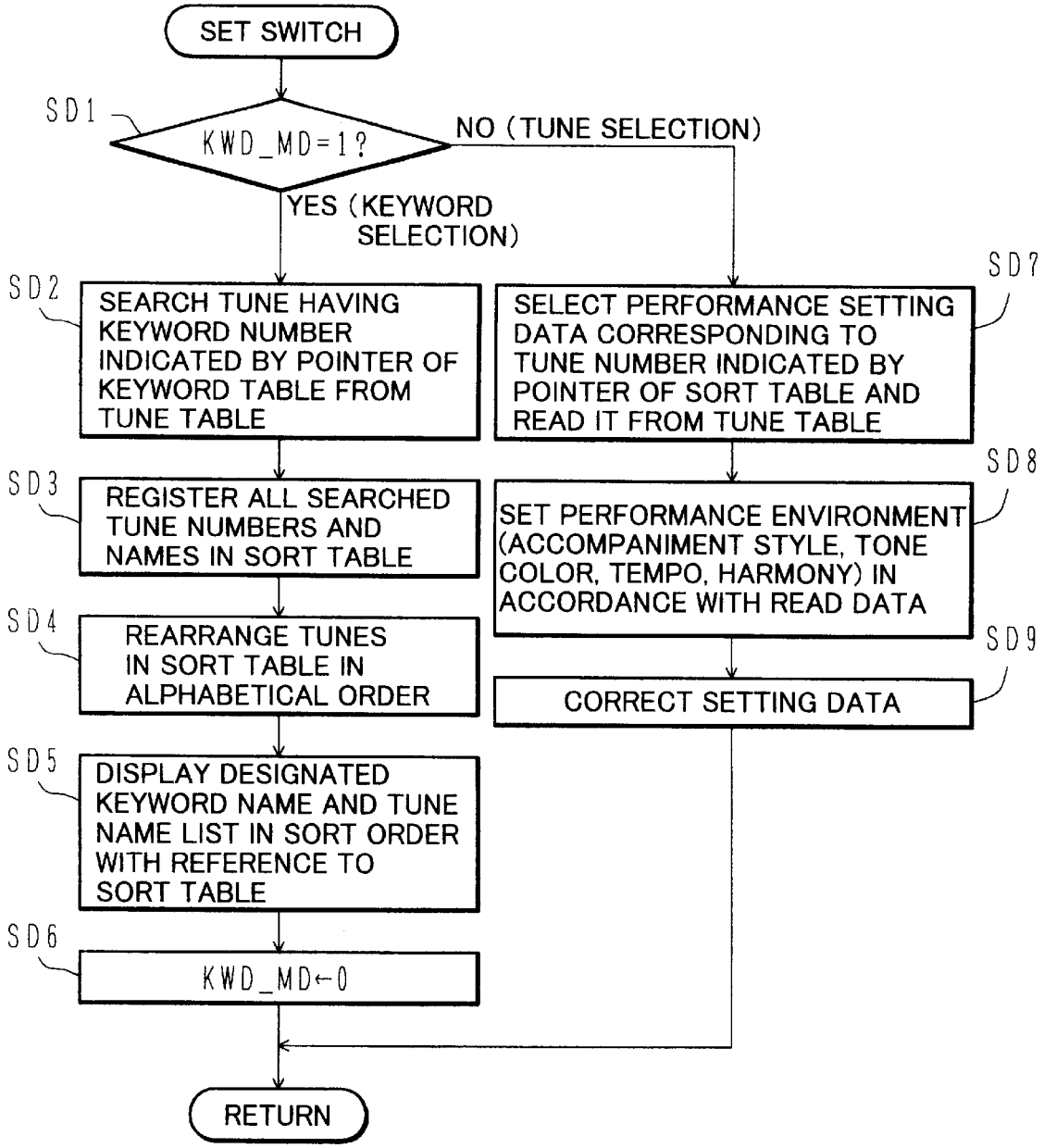
FIG. 13 is a flow chart illustrating an operation to be executed by CPU when a set switch is operated.

FIG. 13 is a flow chart illustrating the operation to be executed by CPU when the set switch is operated.

At Step SD1, it is checked whether the flag KWD_MD is 1. If the flag KWD_MD is 1, it means the keyword selection mode so that the flow advances to Step SD2 along a YES arrow. For example, if the cursor is positioned at a desired artist name or the like in the list displayed on the display screen and the set switch is operated, the flow advances to Step SD2.

At Step SD2, a tune having the keyword number indicated by the address pointer of the keyword table (FIGS. 7A to 7C) is searched from the tune table (FIG. 6). For example, if the artist number No. 1 is selected, a tune number and a tune name having the artist number No. 1 are searched.

At Step SD3, all searched tune numbers and tune names are registered in the sort table (FIG. 10). Since only the tune number and names having the same keyword are registered, the tune numbers are registered generally in a discontinuous order as shown in FIG. 10.

At Step SD4, the tune names in the sort table are rearranged in the alphabetical order or in the Japanese syllabary order. If the tune numbers are being disposed in the alphabetical order of tune names or in the Japanese syllabary order of tune names, the tune names may be sorted in the tune number order and registered in the sort table.

At Step SD5, the designated keyword name is displayed on the display screen. For example, "Artist: Aaaa" is displayed on the upper area of the display screen, as shown in FIG. 3. With reference to the sort table, a list 30 (FIG. 3) of tune names is displayed in the sort order (i.e., in the alphabetical order or in the Japanese syllabary order).

At Step SD6, the flag KWD_MD is set to 0 in order to change the keyword selection mode to the tune selection mode. Thereafter, the process for the set switch is terminated.

If it is judged at Step SD1 that the flag KWD_MD is 0, it means that the mode is the tune selection mode so that the flow advances to Step SD7 along a NO arrow. For example, if the cursor is moved to the position of a desired tune name among the tune names displayed on the display screen and the set switch is operated, the flow advances to Step SD7.

At Step SD7, the performance setting data 38 corresponding to the tune number indicated by the address pointer of the sort table is selected and read from the tune table (FIG. 6).

At Step SD8, the performance environment (such as accompaniment style, tone color, tempo and harmony) is set in accordance with the read performance setting data.

At Step SD9, if a user performs a correction of the performance setting data, the performance environment is set in accordance with the corrected performance setting data. If a user is not satisfied with the performance setting data read from the tune table, the user can correct the performance setting data by using the numerical value change switch (FIG. 4). Thereafter, the corrected performance setting data is set as descried above to terminate the process for the set switch.

Figure 14:
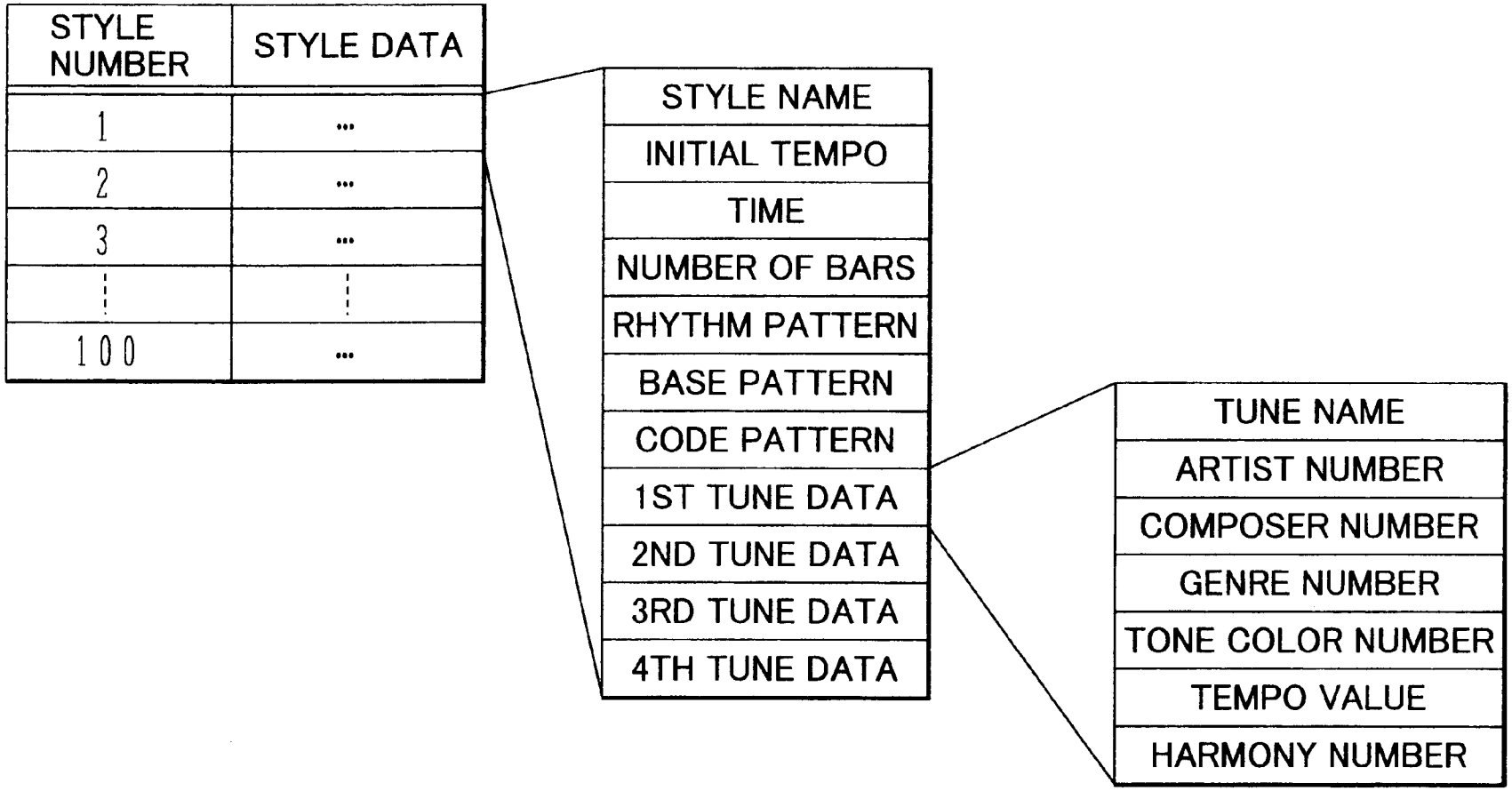
FIG. 14 is a diagram showing of the structure of other sets of style data.

FIG. 14 shows the structure of other sets of style data different from the style data shown in FIG. 8A.

The style data is associated with a style number. The style data includes a style name, an initial tempo, a time, the number of bars of a repetition pattern of accompaniment, a rhythm pattern, a base pattern, a code pattern, and tune data. For example, if there are four tunes corresponding to the style number No. 1, the style data contains first tune data, second tune data, third tune data and fourth tune data.

The tune data includes a tune name, an artist number, a composer number, a genre number, a tone color number, a tempo value, and a harmony number. A keyword search becomes possible by using the artist number, composer number and genre number. Setting the performance setting data such as a tone color number also becomes possible. Since the style data contains tune data, the tune table shown in FIG. 6 becomes unnecessary.

With the configuration that style data contains tune data, it becomes easy to supplement style data. If the style data shown in FIG. 8A is used in place of the style data shown in FIG. 14, it is not easy to supplement new style data. In this case, it is necessary not only to add new style data to the style data shown in FIG. 8A but also to correspondingly register the new style number in the tune table shown in FIG. 6. The operation, therefore, becomes complicated. In contrast, if the style data shown in FIG. 14 is used, it is sufficient if only new style data is added, and the other portions are not necessary to be changed. The operation of adding new data is therefore easy. Style data to be later added may be supplied to users in the form of floppy disk or the like.

Figure 15:
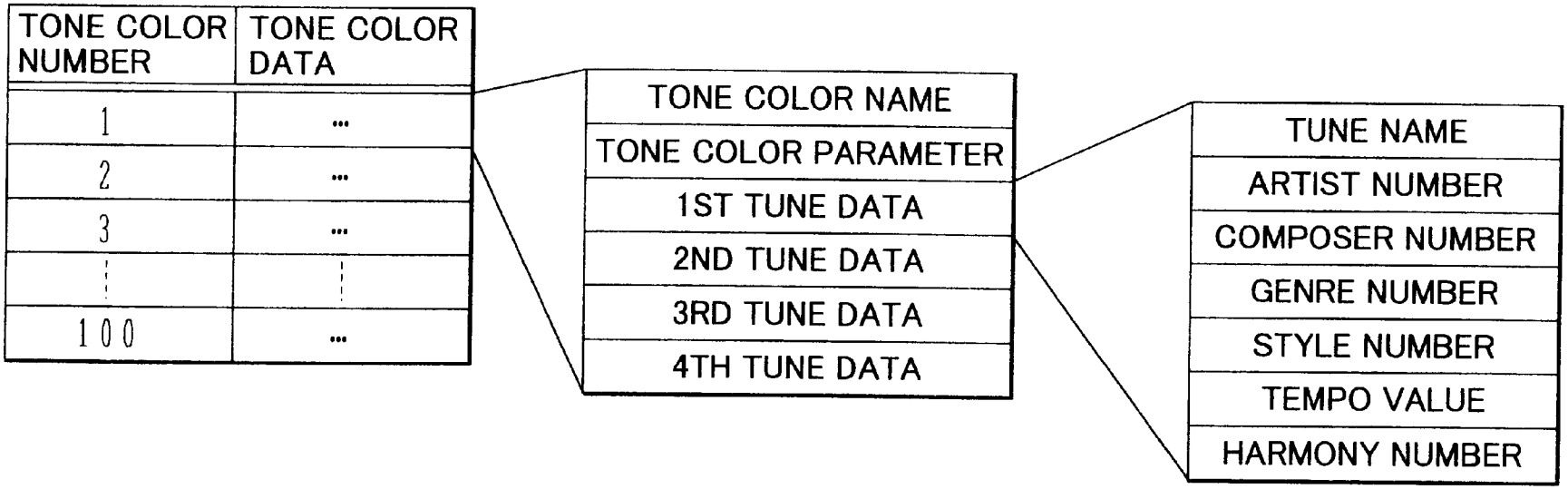
FIG. 15 is a diagram showing of the structure of other sets of tone color data.

FIG. 15 shows the structure of other sets of tone color data different from the tone color data shown in FIG. 8B.

The tone color data is associated with a tone color number. The tone color data includes a tone color name, a tone color parameter, and tune data. For example, if there are four tunes corresponding to the tone color number No. 1, the tone color data contains first tune data, second tune data, third tune data and fourth tune data.

The tune data includes a tune name, an artist number, a composer number, a genre number, a style number, a tempo value, and a harmony number. A keyword search becomes possible by using the artist number and the like, and the tune table shown in FIG. 6 becomes unnecessary. With the configuration that tone color data contains tune data, it becomes easy to supplement tone color data.

Figure 16:
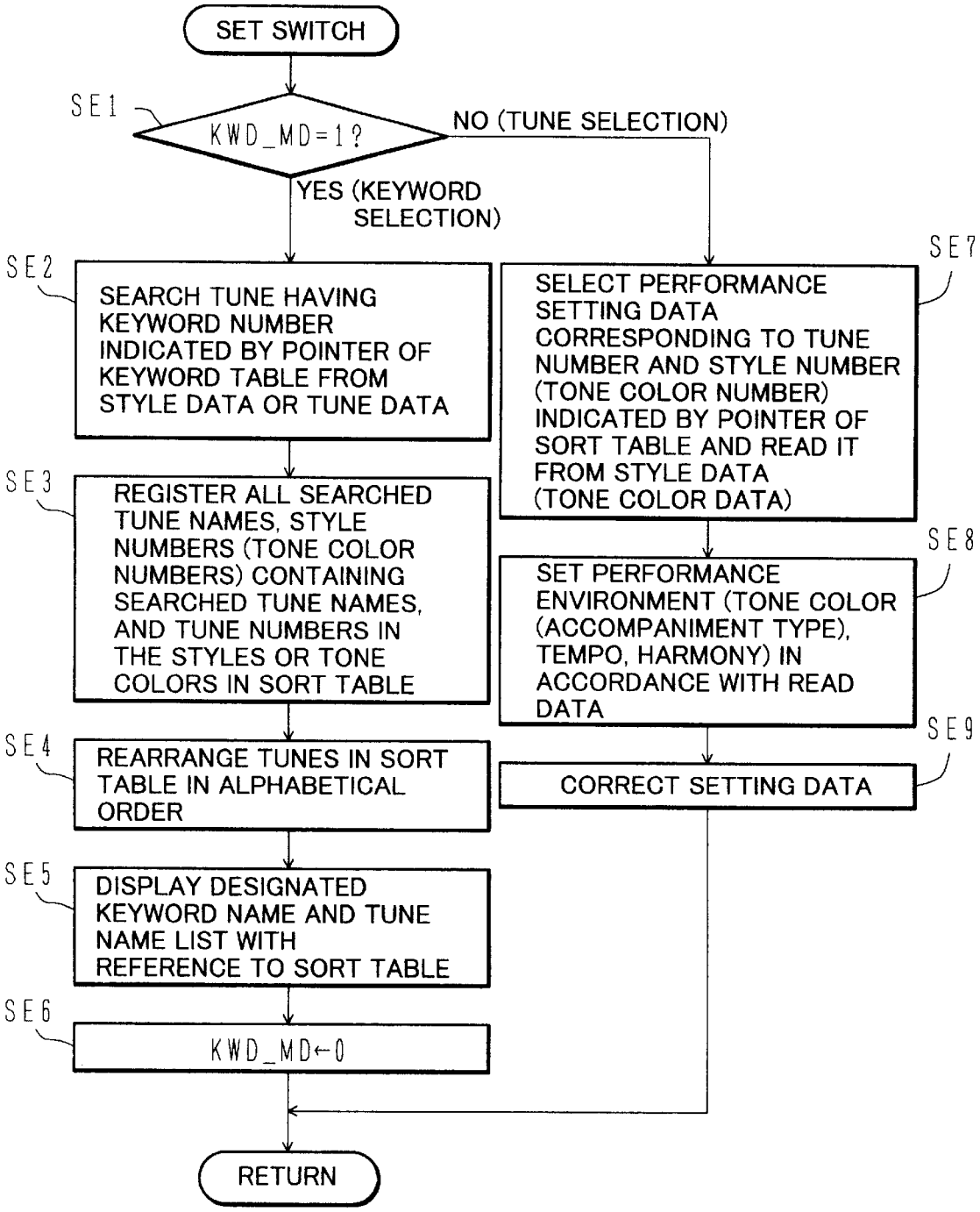
FIG. 16 is a flow chart illustrating another operation to be executed by CPU when a set switch is operated.

FIG. 16 is a flow chart illustrating the operation to be executed by CPU when the style data shown in FIG. 14 or the tone color data shown in FIG. 15 is used and the set switch is operated. This flow chart is used as a substitution for the flow chart shown in FIG. 13.

At Step SE1, it is checked whether the flag KWD_MD is 1. If the flag KWD_MD is 1, it means the keyword selection mode so that the flow advances to Step SE2 along a YES arrow.

At Step SE2, a tune having the keyword number indicated by the address pointer of the keyword table (FIGS. 7A to 7C) is searched from the style data (FIG. 14) or tone color data (FIG. 15).

At Step SE3, all searched tune names, style (tone color) numbers containing the searched tune names, and tune numbers in the styles (tone colors) are registered in the sort table (FIG. 17). As shown in FIG. 17, the sort table stores the style numbers, tune numbers in the styles, and tune names, all being associated with each other.

At Step SE4, the tune names in the sort table are rearranged in the alphabetical order or in the Japanese syllabary order.

At Step SE5, the designated keyword name is displayed on the display screen. With reference to the sort table, a list 30 (FIG. 3) of tune names is displayed in the sort order (i.e., in the alphabetical order or in the Japanese syllabary order).

At Step SE6, the flag KWD_MD is set to 0 in order to change the keyword selection mode to the tune selection mode. Thereafter, the process for the set switch is terminated.

If it is judged at Step SE1 that the flag KWD_MD is 0, it means that the mode is the tune selection mode so that the flow advances to Step SE7 along a NO arrow.

At Step SE7, the performance setting data (excepting style number and tone color number) corresponding to the style number (tone color number) and tune number indicated by the address pointer of the sort table is selected and read from the style data (FIG. 14) or tone color data (FIG. 15).

At Step SE8, the performance environment (such as tone color (or accompaniment style), tempo and harmony) is set in accordance with the read performance setting data. In this case, the performance environment for the style number and tone color number is also set.

At Step SE9, if a user performs a correction of the performance setting data, the performance environment is set in accordance with the corrected performance setting data. Thereafter, the process for the set switch is terminated.

With the performance setting data selecting apparatus of this embodiment, the performance setting data matching a tune to be played can be easily set by selecting a tune name itself, and so-called song image setting is possible. A tune name can be selected easily and quickly by searching the tune name by using an artist, a composer, a genre or the like as a keyword.

If a tune to be played by a user is already determined, the performance setting data matching the tune can be automatically set upon selection of the tune name.

If a user can have particular images of a tune basing upon its tune name, the user can select the tune name easily without being embarrassed. Performance imaged by a user becomes likely to match the actually played performance.

The performance setting data may include: in addition to an accompaniment style and a tone color, chord progression data; intro pattern data; ending pattern data; effects data such as reverb; left hand chord designating mode (single finger, finger chord, full keyboard, and so on) data; volume data of a melody part, an accompaniment part or the like; and other data. The keyword may include other keywords in addition to an artist name, a composer and a genre.

The performance setting data selecting apparatus is not limited only to the form of an electronic musical instrument, but may be realized by a combination of a personal computer and application software. The application software stored in a recording medium such as a magnetic disk may be supplied to the personal computer or it may be supplied via a network to the personal computer.

The performance setting data selecting apparatus may be realized as an integrated part of an electronic musical instrument with built-in sound source and automatic performance units, or may be realized as a discrete part of such an electronic musical instrument interconnected by communication means such as MIDI and networks. The invention is not limited only to keyboard musical instruments, but may be applied to other instruments such as stringed musical instruments, wind musical instruments, and percussion musical instruments.

The present invention has been described in connection with the preferred embodiments. The invention is not limited only to the above embodiments. It is apparent that various modifications, improvements, combinations, and the like can be made by those skilled in the art.

What is claimed is:

1. A performance setting data selecting apparatus comprising:

means for storing a correspondence between each of a plurality of tune names and performance setting data suitable for playing each tune;

means for designating the tune name of each tune; and means for setting the performance setting data corresponding to the tune name of each tune designated by said designating means by reading the performance setting data from said storing means.

2. A performance setting data selecting apparatus according to claim 1, wherein said storing means comprises:

data storing means for storing a plurality set of performance setting data; and a table for storing a correspondence between each tune name of the plurality of tunes and each set of the performance setting data stored in said data storing means suitable for playing a tune having the associated tune name, and said designating means reads the performance setting data corresponding to the tune name designated by said designating means from said data storing means by referring to said table and setting the read performance setting data.

3. A performance setting data selecting apparatus according to claim 1, wherein said storing means stores a plurality set of performance setting data and stores a correspondence, for each set of the performance setting data, between a tune name or names and each set of the performance setting data suitable for playing a tune having the associated tune name or names.

4. A performance setting data selecting apparatus according to claim 1, wherein the performance setting data includes at least one of an accompaniment style, a tone color, a tempo and a harmony.

5. A performance setting data selecting apparatus according to claim 1, wherein said setting means changes the performance setting data read from said storing means in accordance with a user instruction and sets the changed performance setting data.

6. A performance setting data selecting apparatus according to claim 1, further comprising means for displaying the tune names stored in said storing means on a display device.

7. A performance setting data selecting apparatus according to claim 6, wherein said displaying means sorts the tune names and displays the sorted tune names, in accordance with a predetermined rule.

8. A performance setting data selecting apparatus according to claim 6, wherein said displaying means displays only the tune names searched by keyword searching.

9. A performance setting data selecting apparatus according to claim 7, wherein said displaying means sorts the tune names in an alphabetical order and displays the sorted tune names.

10. A performance setting data selecting apparatus according to claim 8, wherein said displaying means performs a search by using at least one of an artist, a composer, and a genre as a keyword.

11. A performance setting data selecting apparatus according to claim 3, wherein said storing means stores the plurality set of performance setting data and the tune names, the performance setting data sets and the tune names being associated with each other.

12. A performance setting data selecting apparatus according to claim 6, wherein said displaying means displays the performance setting data read by said setting means from said storing means on the display device.

13. A performance setting data selecting apparatus according to claim 12, wherein said setting means changes the performance setting data displayed by said displaying means in accordance with a user instruction and sets the changed performance setting data.

14. A performance setting data selecting apparatus comprising:

memory which stores a plurality of performance setting data suitable for playing a plurality of tunes and respective correspondences between the plurality of performance setting data and the plurality of tunes;

designating device which designates one of the plurality of tunes;

controlling device which sets one of the plurality of performance setting data corresponding to the designated tune by reading out the one from the memory based on the correspondences, wherein an automatic accompaniment of the designated tune is executed under the set performance setting data.

15. A performance setting data selecting method comprising the steps of:

(a) preparing means for storing a correspondence between each of a plurality of tune names and performance setting data suitable for playing each tune;

(b) designating the tune name of each tune; and (c) setting the performance setting data corresponding to the tune name of each designated tune by reading the performance setting data from said storing means.

16. A medium storing a program to be executed by a computer, the program comprising the processes of:

(a) preparing means for storing a correspondence between each of a plurality of tune names and performance setting data suitable for playing each tune;

(b) designating the tune name of each tune; and (c) setting the performance setting data corresponding to the tune name of each designated tune by reading the performance setting data from said storing means.

17. A medium according to claim 16, wherein said storing means comprises:

data storing means for storing a plurality set of performance setting data; and a table for storing a correspondence between each tune name of the plurality of tunes and each set of the performance setting data stored in said data storing means suitable for playing a tune having the associated tune name, and said process (c) reads the performance setting data corresponding to the designated tune name from said data storing means by referring to said table and setting the read performance setting data.

18. A medium according to claim 16, wherein said process (a) prepares the storing means for storing a plurality set of performance setting data and storing a correspondence, for each set of the performance setting data, between a tune name or names and each set of the performance setting data suitable for playing a tune having the associated tune name or names.

19. A medium according to claim 16, wherein the performance setting data includes at least one of an accompaniment style, a tone color, a tempo and a harmony.

20. A medium according to claim 16, wherein said process (c) changes the performance setting data read from said storing means in accordance with a user instruction and sets the changed performance setting data.

21. A medium according to claim 16, further comprising the process (d) of displaying the tune names stored in said storing means on a display device, before said process (b).

22. A medium according to claim 18, wherein said process (a) prepares the storing means for storing a correspondence between each set of the performance setting data and a plurality of tune names, after said process (b).

23. A medium according to claim 21, wherein said process (d) displays only the tune names searched by keyword searching.

* * * * *